US007353758B2

(12) United States Patent
Murray

(10) Patent No.: US 7,353,758 B2
(45) Date of Patent: Apr. 8, 2008

(54) TRACK AND VEHICLE AMUSEMENT APPARATUS AND METHODS

(75) Inventor: Brent W. Murray, Longmont, CO (US)

(73) Assignee: Miniature Amusements, LLC, Longmont, CO (US)

( * ) Notice: Subject to any disclaimer, the term of this patent is extended or adjusted under 35 U.S.C. 154(b) by 0 days.

(21) Appl. No.: 11/450,986

(22) Filed: Jun. 12, 2006

(65) Prior Publication Data

US 2006/0230974 A1 Oct. 19, 2006

Related U.S. Application Data

(62) Division of application No. 10/795,160, filed on Mar. 5, 2004, now abandoned.

(51) Int. Cl.
*A63G 1/00* (2006.01)

(52) U.S. Cl. ..... 104/53

(58) Field of Classification Search ..... 104/53, 104/55, 63, DIG. 1; 105/1.5
See application file for complete search history.

(56) References Cited

U.S. PATENT DOCUMENTS 1,405,213 A 1/1922 Hingenitz
2,642,005 A 6/1953 Wallin
3,374,974 A 3/1968 Furrer et al.
3,559,334 A 2/1971 Beny et al.
3,796,429 A 3/1974 Johnston
4,221,170 A 9/1980 Koudelka
4,799,916 A 1/1989 McKay et al.
5,118,320 A * 6/1992 Miller ..... 446/288
D344,310 S 2/1994 Ruszkai
5,555,815 A 9/1996 Young et al.
6,158,354 A 12/2000 Eiraku
6,348,004 B1 2/2002 Houben
6,397,756 B1 6/2002 Saiko et al.
6,508,179 B2 1/2003 Annis et al.
6,572,434 B2 6/2003 Man
6,708,623 B2 3/2004 Cummins

* cited by examiner

*Primary Examiner*—S. Joseph Morano
*Assistant Examiner*—Robert J. McCarry, Jr.
(74) *Attorney, Agent, or Firm*—Harold A. Burdick

(57) ABSTRACT

A track a vehicle amusement apparatus and methods are disclosed, the apparatus including a vehicle or vehicles movable over a track assembly supported and elevated by a supporting assembly. A plurality of track sections define the track assembly, and the vehicles have wheels, some positioned above and some below the track and at different locations across the track. Drive track sections of the track assembly include first and second relatively reciprocating track members, the vehicles including independently retractable appendages for releasable engagement with different ones of the track members.

20 Claims, 17 Drawing Sheets

167
171
173
145
143
147
151
169
177

TRACK AND VEHICLE AMUSEMENT APPARATUS AND METHODS

RELATED INVENTION

This invention is a divisional application of U.S. patent application Ser. No. 10/795,160 filed Mar. 5, 2004 now abandoned by the inventor herein and entitled TRACK AND VEHICLE AMUSEMENT APPARATUS AND METHODS.

FIELD OF THE INVENTION

This invention relates to toy and model vehicle devices and methods, and, more particularly, relates to toy or model vehicles configured in conjunction with a track to move about the track.

BACKGROUND OF THE INVENTION

Various toy and/or model train, car or other vehicles used in association with tracks specially adapted thereto have been heretofore known and/or utilized. The various vehicles have included highly accurate scale model vehicles configured to run on electrified rail systems, gravity operated systems utilizing ramps, barriers, or other vehicle movement retention systems, and mechanical systems (wind up or similarly powered vehicles, for example).

While such heretofore known systems are in wide use, such systems have not usually been well adapted for movement of the vehicle up steep track grades without undue complexity, have not been particularly suitable for a variety of model types that are less common (such as functional roller coaster modeling for example), have not provided track elevation, directing and support systems that are extensive and durable, and/or have utilized drive systems that are complex, expensive or unreliable. Further improvement could thus be utilized.

SUMMARY OF THE INVENTION

This invention provides vehicle and track amusement apparatus and methods for use with toys, models and the like. The apparatus is adapted for facile movement of the vehicle up steep track grades, is simple to implement and use, is well suited for use with less common model types such as functional roller coaster models, and incorporates extensive and durable track elevation, directing and support systems.

The amusement apparatus includes a plurality of track sections defining a track assembly, with each track section having a top and a bottom surface and first and second relative track elevations (at least at the top surface). A vehicle having at least first and second wheels is adapted for movement on the track assembly, with the first wheel positionable adjacent to the top surface at the first relative track elevation and remaining lateral of the second relative elevation of the track sections. The second wheel is positionable adjacent to the bottom surface of the track sections.

The vehicle has a front, a rear and opposite sides, and preferably includes third and fourth wheels. The third wheel is positionable adjacent to the bottom surface of the track sections with the second and third wheels each adjacent to a different one of the vehicle sides. The fourth wheel is positionable adjacent to the top surface of the track sections, the first and fourth wheels each adjacent to a different one of the vehicle front and the vehicle rear.

At least one of the track sections includes first and second relatively reciprocating track members. Each of the track members has an engageable aspect (serially arranged teeth, for example). The vehicle has first and second independently retractable appendages maintained thereon, the first appendage positioned for repeated releasable engagement at the engageable aspect of the first track member when the vehicle is positioned thereat. The second appendage is positioned for repeated releasable engagement at the engageable aspect of the second track member.

The first track member includes a protrusion engageable by a drive mechanism for causing movement of the first track member relative to the second track member. The drive mechanism includes a rotational drive and means for translating rotational motion to linear motion connected between the drive and the first track member.

The second track member preferably includes spaced tracks, the first track member movable between the spaced tracks of the second track member. In such a case, the vehicle preferably includes a third independently retractable appendage, the second appendage engageable at one of the spaced tracks and the third appendage positioned for repeated releasable engagement at the other of the spaced tracks.

The method of this invention provides for moving a model vehicle up an incline on a model track. First and second track members of the model track are relatively reciprocated. A first retractable appendage located at the model vehicle repeatedly releasably engages the first track member and a second retractable appendage located at the model vehicle independently repeatedly releasably engages the second track member. In this way, one track member/appendage combination moves the vehicle up the incline while the other track member/appendage combination prevents backsliding of the vehicle.

It is therefore an object of this invention to provide improved vehicle and track apparatus and method for use with toys, models and the like.

It is another object of this invention to provide vehicle and track amusement apparatus and methods adapted for facile movement of the vehicle up steep track grades.

It is still another object of this invention to provide vehicle and track amusement apparatus and methods well suited for use with less common model types such as functional roller coaster models.

It is yet another object of this invention to provide vehicle and track amusement apparatus that are simple to implement and use and that incorporate extensive and durable track elevation, directing and support systems.

It is still another object of this invention to provide a track and vehicle amusement apparatus including a plurality of track sections each having first and second oppositely facing surfaces and first and second relative track elevations at least at the first surface, the first relative track elevation being located intermediate the second relative track elevation and extending longitudinally the length of each the track section, each track section including connecting structure at opposite ends thereof adjacent to the first relative track elevation, connectors engageable at the connecting structure of the track sections, at least some of the connectors including a fitting at a surface thereof and configured for rotatable engagement therewith, track support and elevation members selectively configurable in various lengths and each including an engaging structure rotatably engageable with a selected the fitting of the some of the connectors, and a first vehicle mountable on the track sections.

It is another object of this invention to provide a track and vehicle amusement apparatus including a plurality of track sections defining a track assembly, each track section having top and bottom surfaces, at least one of the track sections including first and second relatively reciprocating track members with each of the track members having an engageable aspect, and a first vehicle having at least first and second wheels and first and second independently retractable appendages, the first wheel positionable adjacent to the top surface of the track sections and the second wheel positionable adjacent to the bottom surface of the track sections, the first appendage positioned for repeated releasable engagement at the engageable aspect of the first track member of the at least one of the track sections when the vehicle is positioned thereat, and the second appendage positioned for repeated releasable engagement at the engageable aspect of the second track member of the at least one of the track sections when the vehicle is positioned thereat.

It is still another object of this invention to provide a method for moving a model vehicle up an incline on a model track including the steps of relatively reciprocating first and second track members of the model track, repeatedly releasably engaging a first retractable appendage located at the model vehicle at the first track member, and independently repeatedly releasably engaging a second retractable appendage located at the model vehicle at the second track member.

With these and other objects in view, which will become apparent to one skilled in the art as the description proceeds, this invention resides in the novel construction, combination, and arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
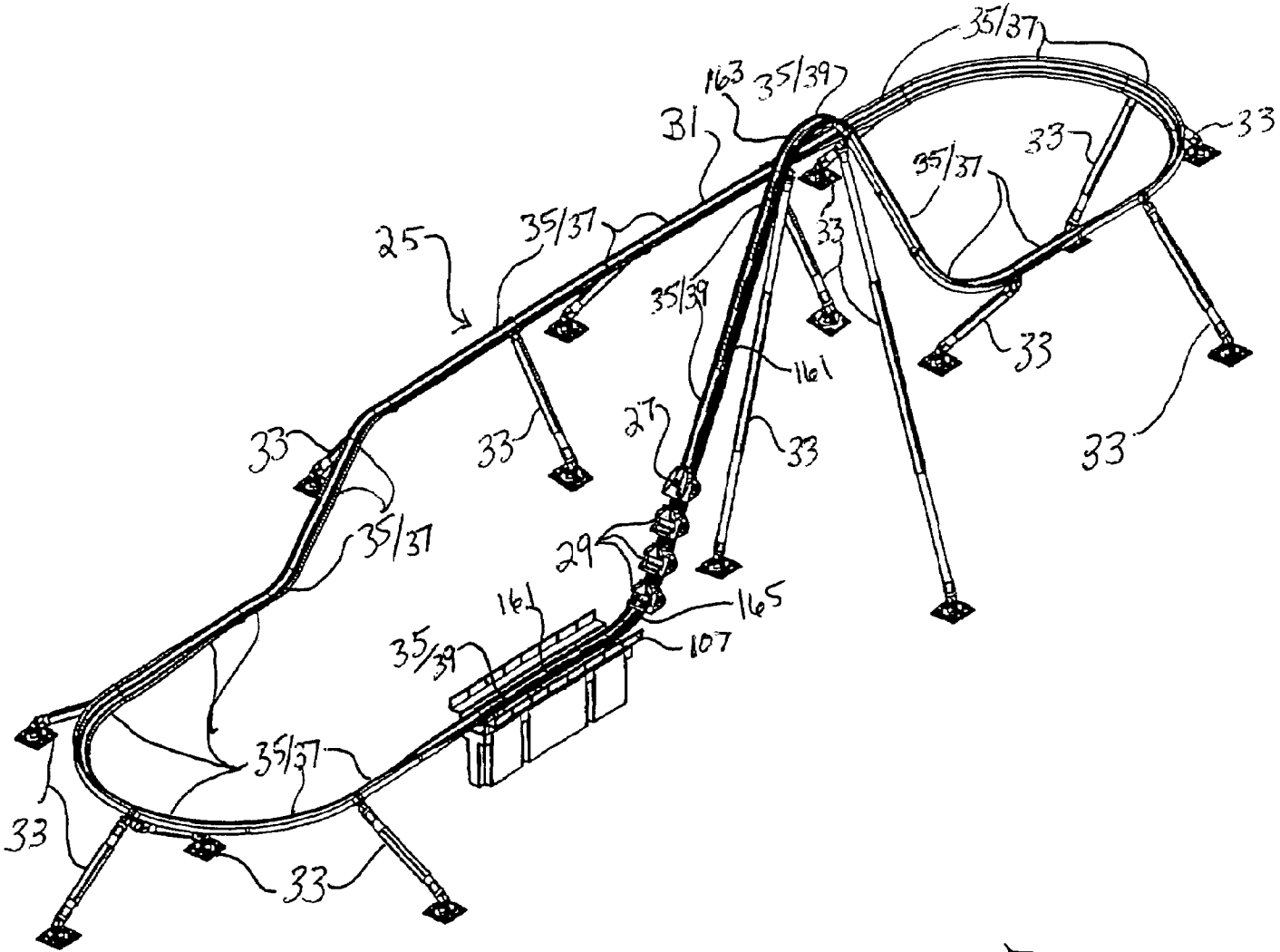
FIG. 1 is a perspective view of the apparatus of this invention.

Apparatus 25 of this invention is illustrated in FIG. 1 showing the overall assembly including individual inventive component apparatus and devices as will become apparent as the description proceeds. In the illustrated case, the apparatus is embodied as a functioning model roller coaster having multiple vehicles (or cars) including a lead vehicle 27 and additional vehicles 29 (see also FIG. 2). It should be understood however, that the various apparatus, devices and methods of this invention could be differently configured and modeled for other toy and/or model applications.

Apparatus 25 includes three basic assemblies, vehicle(s) 27/29, track assembly 31 and supporting assemblies 33. Track assembly 31 is established by a plurality of linked track sections 35 and includes passive track sections 37 and drive track sections 39 (see also FIG. 2). These track sub-assemblies share some structural characteristics (an overall modified "Y" configuration), but are distinct in many regards and in function as will become apparent as the description proceeds.

Figure 2:
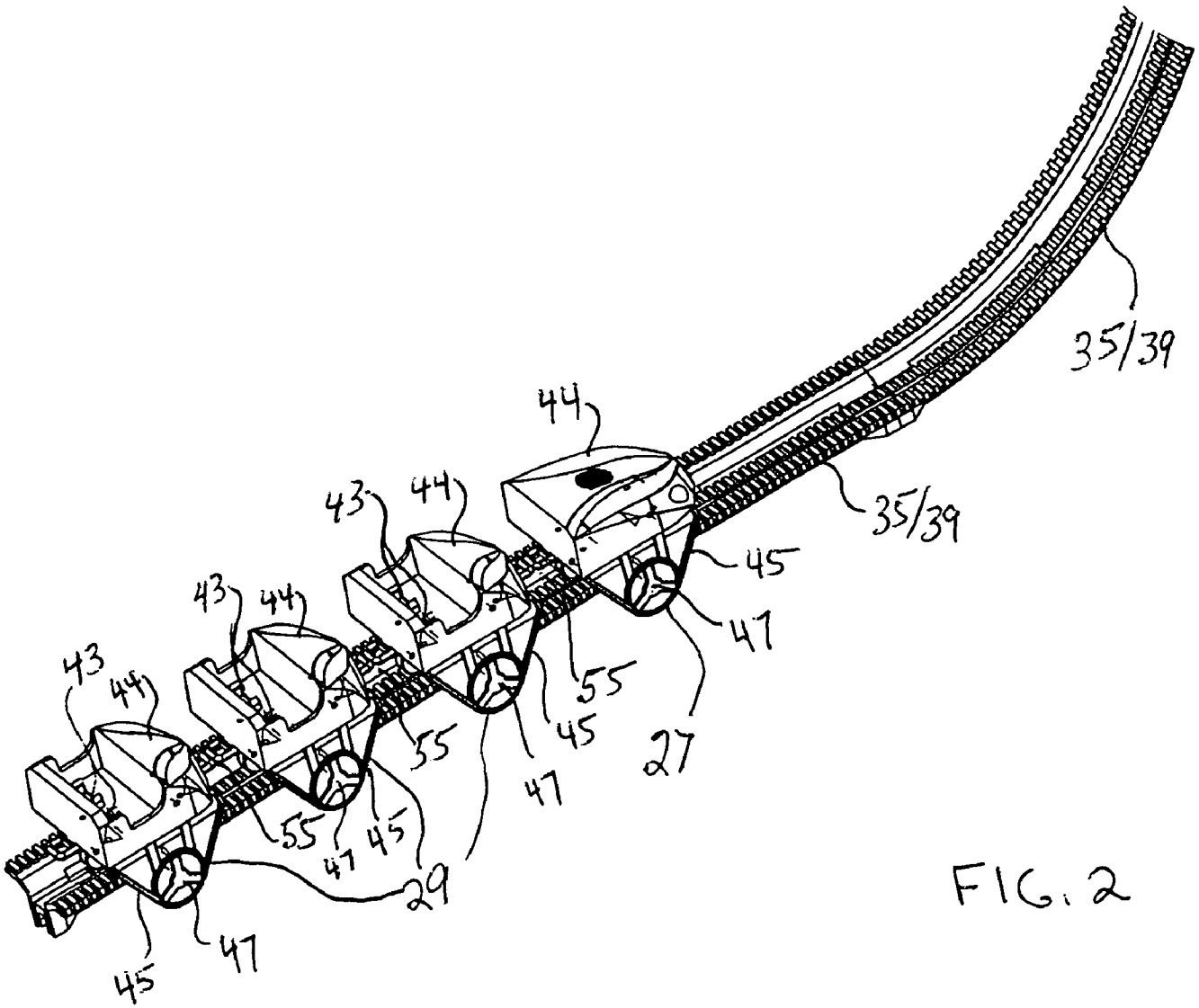
FIG. 2 is a perspective view of a portion of the track and a set of vehicles (or cars) thereon.
Figure 3:
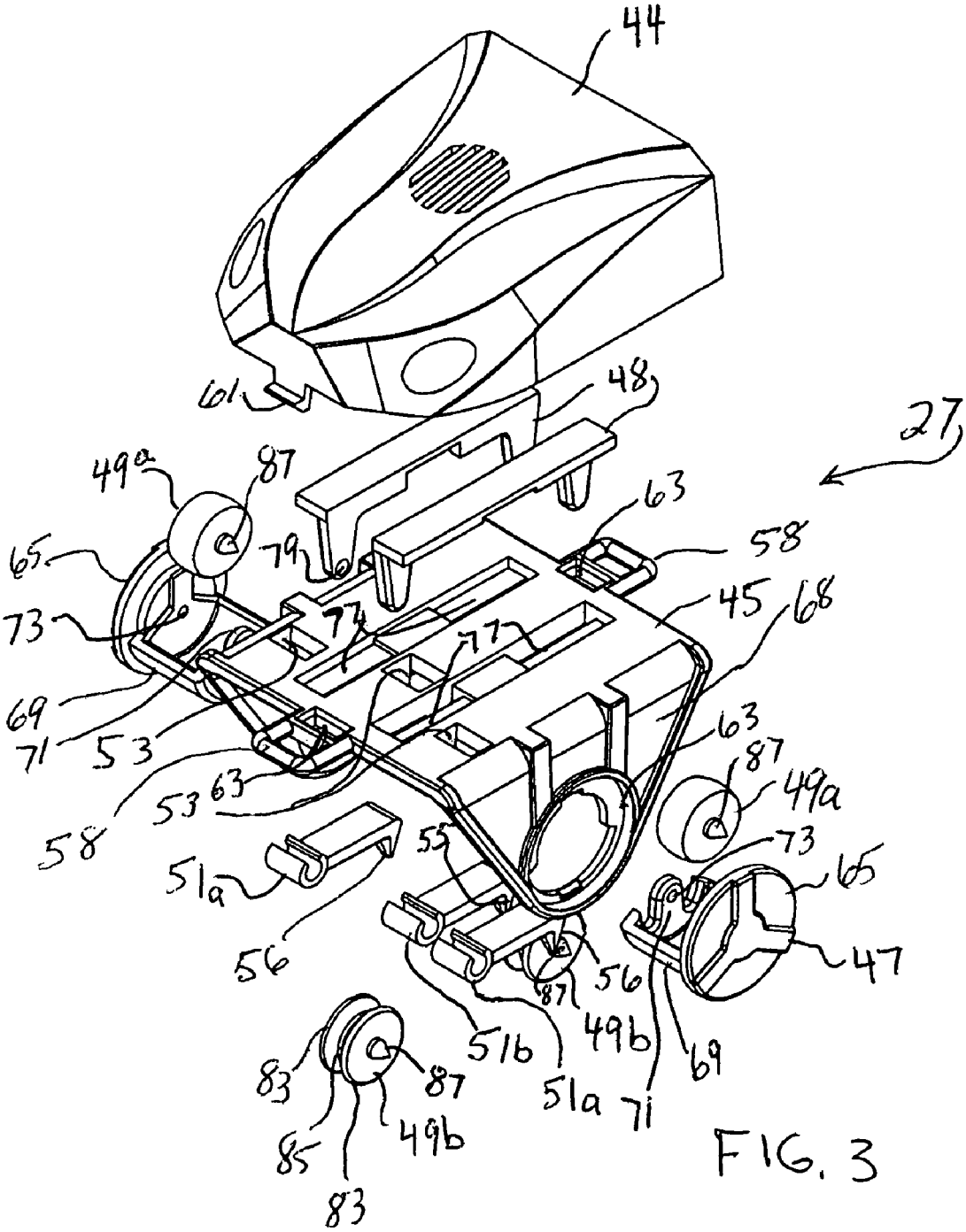
FIG. 3 is an exploded view of one of the vehicles of this invention (all vehicles being substantially similar in most cases)
Figure 4:
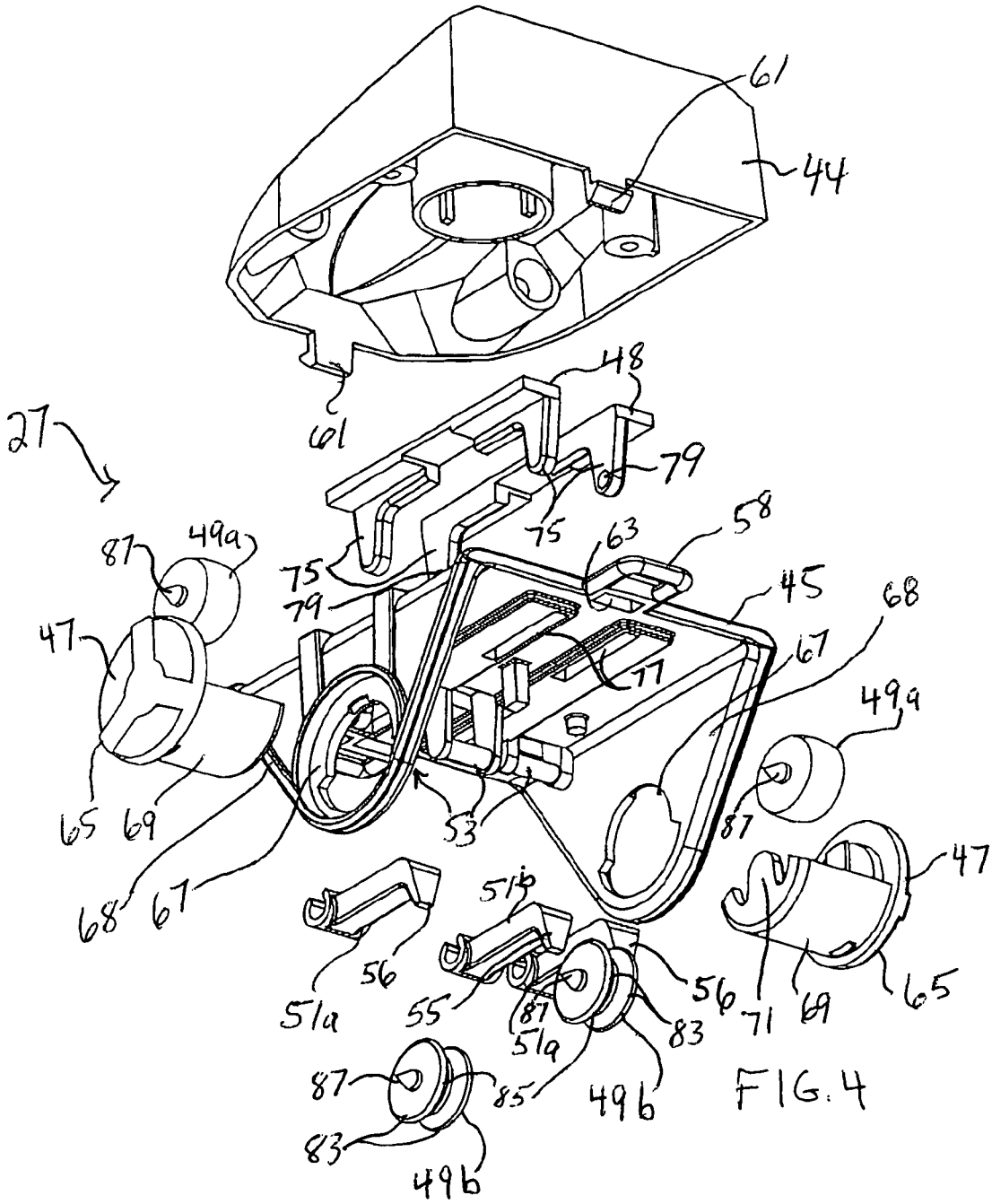
FIG. 4 is a second exploded view of the vehicle of FIG. 3.
Figure 5:
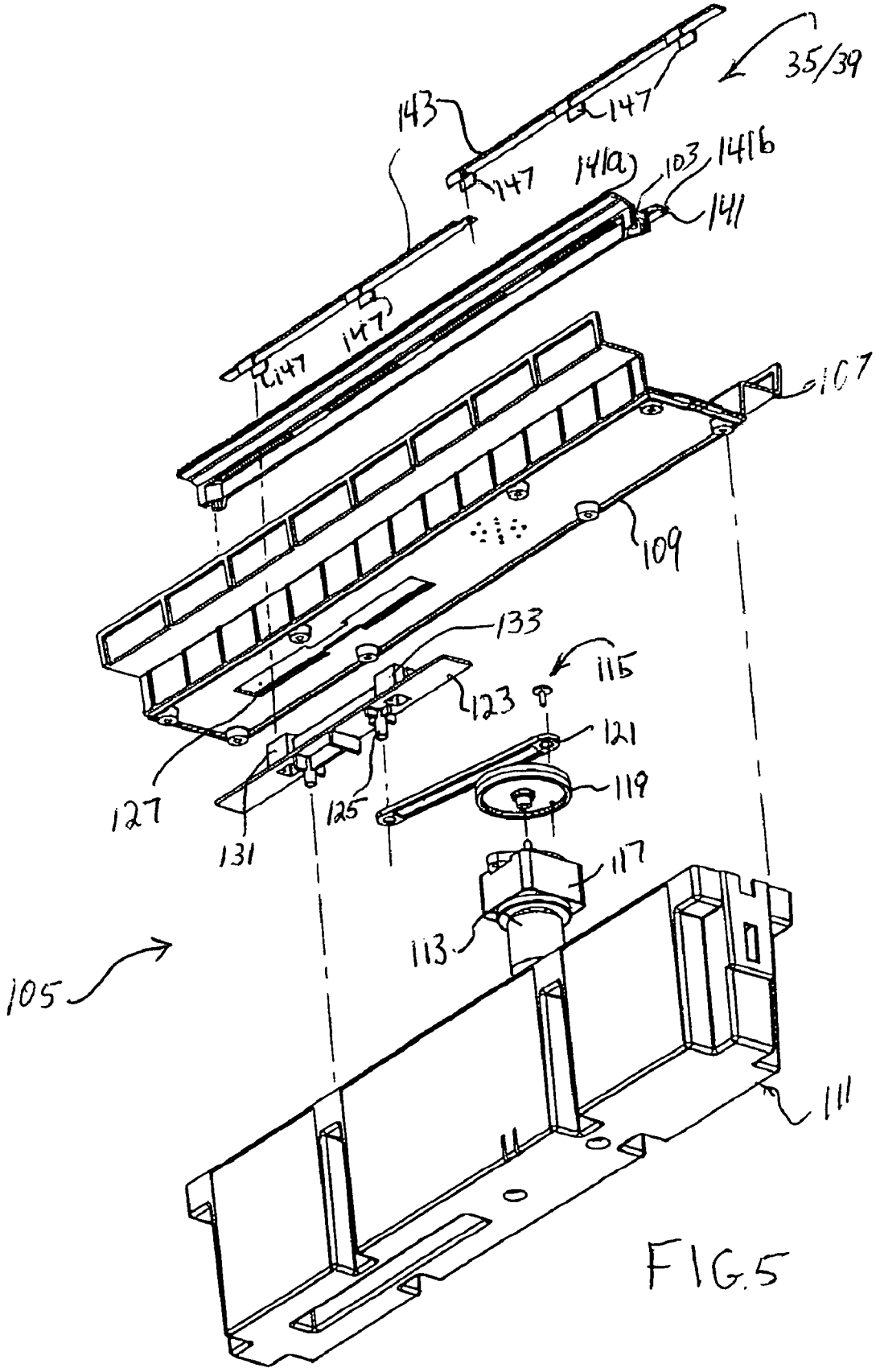
FIG. 5 is and exploded view of the drive track mechanism of the apparatus of this invention.
Figure 6:
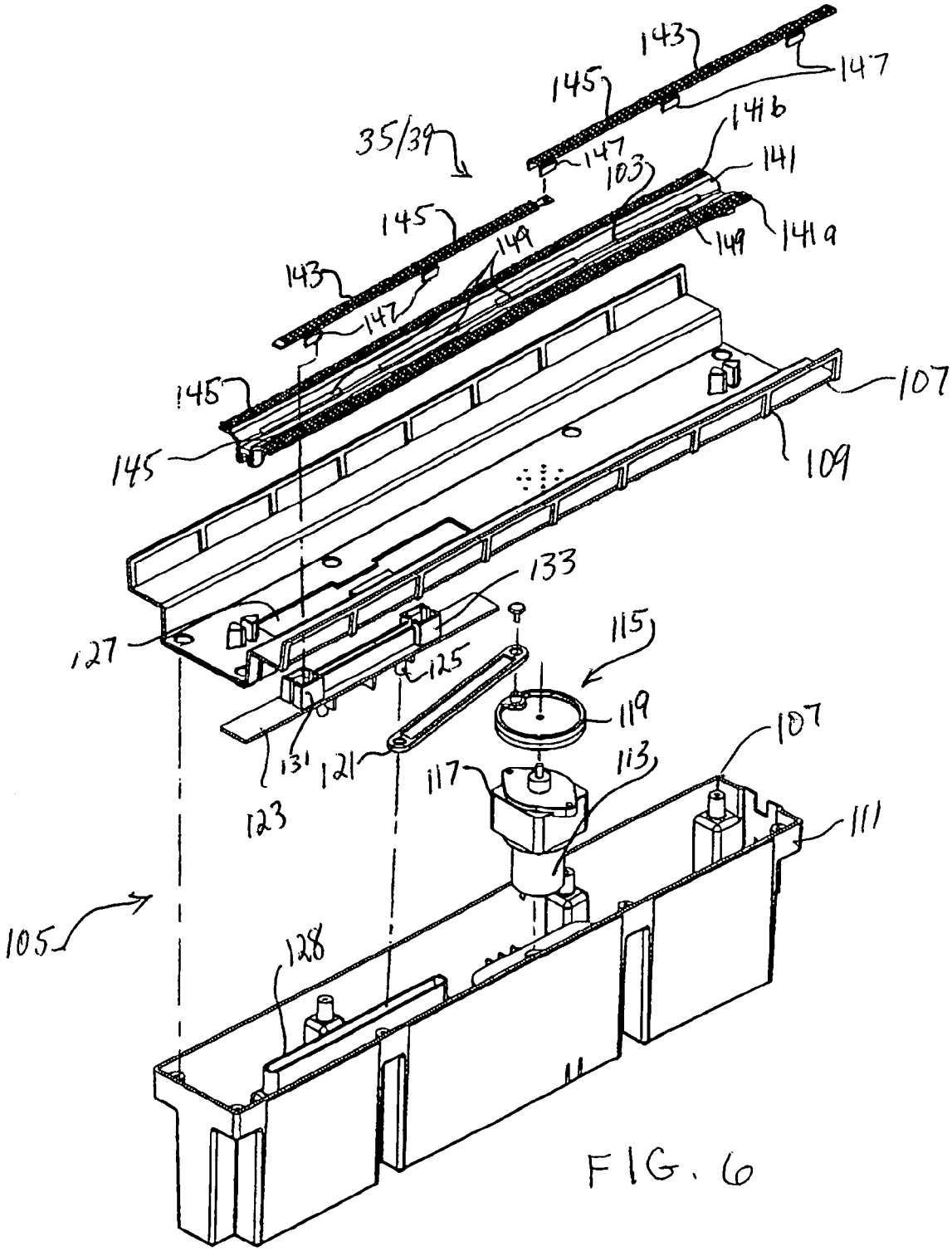
FIG. 6 is a second exploded view of the drive track mechanism of FIG. 5.

Vehicles 27/29 are illustrated in FIGS. 2 through 4 (for ease of illustration, only vehicle 27 is shown in FIGS. 2 and 3, the additional vehicles 29 being substantially similarly constructed except as may be noted herein). In the configuration as a roller coaster model, lead vehicle 27 has passenger vehicles 29 connected thereto. Such models can be made on any selected scale, for example, "O" scale. While not shown, the cars may be provided with model riders that snap into seats 43 of passenger vehicles 29.

Each vehicle includes body 44 mounted on truck 45, wheel holders 47 mounted on truck 45 and wheel holders 48 mounted or integral to truck 45. Wheels 49 (four are preferred, though fewer could be conceived) are held by holders 47/48 (wheels 49*a* at holders 47 and wheels 49*b* at holders 48). Independently repeatedly retractable appendages 51*a* and independently repeatedly retractable appendage 51*b* are pivotably mounted at integral mount bars 53 at, but spaced from, the bottom of truck 45. Drive tab 55 is formed at one end of appendage 51*b* and backslide retention tabs 56 are formed at one end of appendages 51*a*. The lowered position of tabs 55/56, relative to truck 45 ensures engagement at drive track sections 39 even at extreme lift angles. Coupler loops 58 are provided at the front and rear of each vehicle (for coupling, in conjunction with a coupling bar snapped over the loops to couple the vehicles—not shown—the vehicles in a vehicle train).

The cross section of coupler loops 58 and the coupling bars when engaged is round to allow for maximum twist without binding in all directions and creating a single point of contact to minimize friction for maximizing independent movement of each vehicle. Independent movement of each coupled vehicle in these couplings is critical in preventing energy loss.

Body 44 snaps into truck 45 at latches 61 through truck openings 63. Wheel mounts 47 include rims 65 mounted in openings 67 through wings 68 of truck 45, and have wheel shells 69 supporting inner mounts 71. Inner and outer axle mount detents 73 (not all of which are shown in the FIGURES) are defined in each wheel mount 47 at mounts 71 and rims 65, respectively. Wheel mounts 48 include wheel supports 75 at each end thereof which extend through openings 77 in truck 45 when mounts 48 are secured thereon. An axle mount detent 79 is formed in each of supports 75 (not all of which are shown in the FIGURES).

All of the vehicle components are designed to be light weight and low profile to keep a low center of gravity. Wheels 49*a* and 49*b* are preferably made of a heavier material (brass for example) for increasing weight to locate the center of gravity nearest to the track. Each of the four wheels preferable includes dual (minimized) contact surfaces 83 separated by groove 85 as shown with respect to wheels 49*b* (though alternative constructions, as shown with respect to wheels 49*a*, could be utilized). The corner edges of the wheels are preferably rounded to keep the wheels slipping (and not climbing out of the trough established by track assembly 31 to help vehicles run true). The wheels' shape also clears any holes in track that may cause slowing. Overall, the wheel configuration locks the vehicles onto the track while leaving a loose enough fit so that the vehicles can maneuver around tight turns, up and down, and over drive track sections 39.

Integral wheel axles 87 (one on each side of each wheel) are received at their related axle mount detents 73/79 of mounts 47/48 and are formed with a sharp point at their outer extremity. This creates a single point of contact closest to the center of the axle that minimizes surface contact and distance per revolution to maximize friction reduction.

Wheel mounts 47/48 are preferably made of a low coefficient of friction plastic such as Delrin. Minimizing friction at wheels 49 (as well as energy loss do to track movement) is critical in order to more nearly establish performance characteristics of the model approaching those of modeled full size system. Wheels 49*b* are oriented and positioned so that the two in-line wheels, one adjacent vehicle front and one adjacent vehicle rear, are located on top of the track as discussed hereinafter. Wheels 49*a* are oriented and positioned to be located beneath the track, one each at each of the vehicle's opposite sides but oriented toward the center of vehicle(s) 27/29 (again as discussed below). Wheels 49*a* are positioned so that they only come in contact with the track when vehicles 27/29 are changing directions and leaning to one side.

Lead vehicle 27 includes all three of appendages 51 required to lift the vehicles in conjunction with drive track sections 39. Additional vehicles 29 may also include appendages 51, or may only some appendages 51 (drive appendage 51*b*, backslide prevention appendages 51*a*, or only one of each, for example) or no appendages 51 at all. Drive tab 55 at appendage 51*b* is located in the center of the vehicle between the in-line wheels 49*b* so that it will engage a corresponding drive strip track member of drive track sections 39 as discussed hereinbelow. Drive tabs 55/56 have a 90° bend at the end to ensure engagement with the teeth of the respective track members of the drive track sections. The end of the bend of drive tabs 55/56 is tapered and rounded on the backside to ensure minimum drag around track assembly 31 and to ensure disengagement from the teeth of drive track sections 39 as the vehicles move forward, while the front edges of the ends of tabs 55/56 are flat to help lock into the teeth, as discussed below. The snap on openings in appendages 51 are oriented so that the direction of loading will not cause binding or failure at the pivot. The outer drive tabs operate the same as center tab but engage the track teeth.

Lead vehicle 27 of this embodiment does not carry modeled people and may be designed to enclose a light and sound card with batteries. The sound card has a reed switch or Hall effect device that activates the card as it passes over magnets placed selectively into track sections 35. The sound card produces recorded dialog or sound effects (screams for example) when triggered. The card may also be provided with lights (head lights, for example) such as LED'S.

Figure 10:
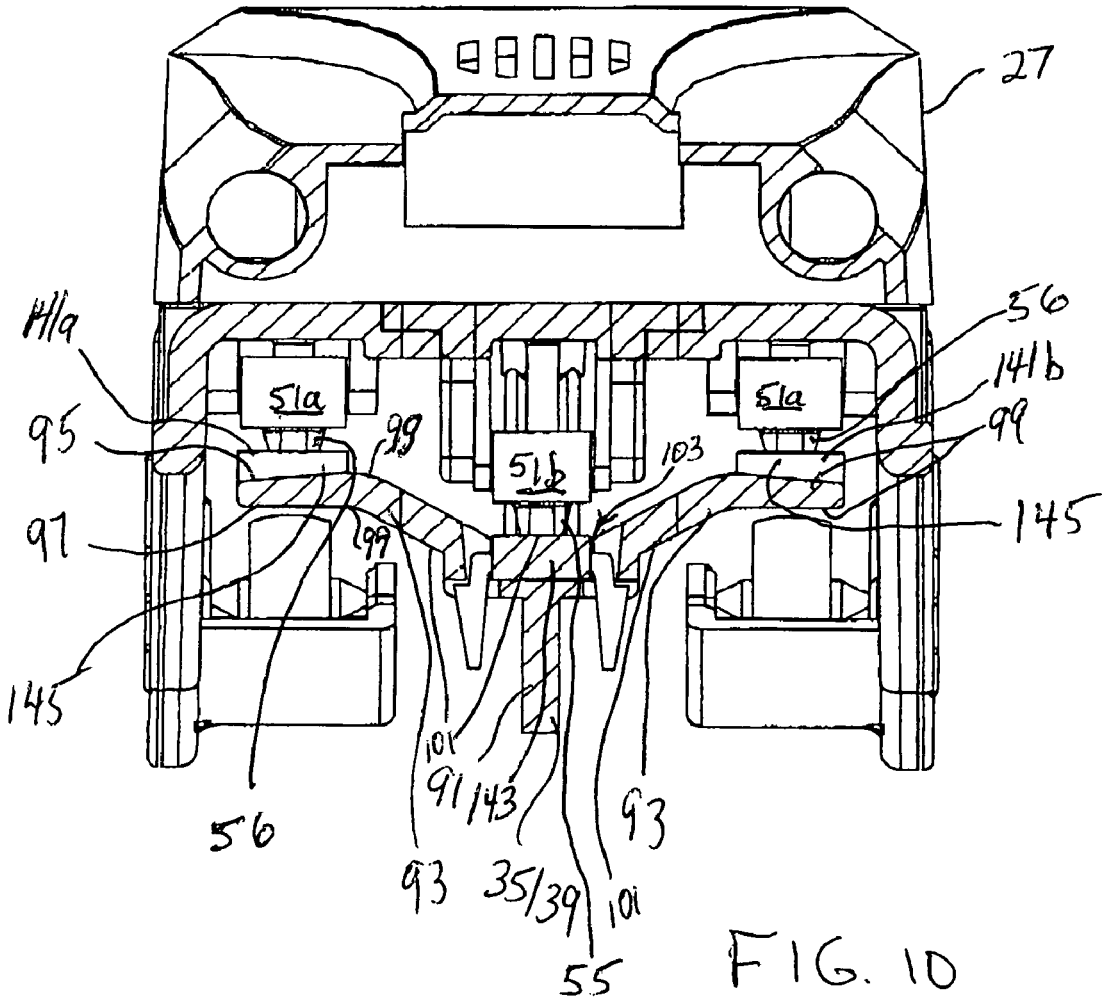
FIG. 10 is a second sectional illustration (at 90° from the section of FIG. 9) of the vehicle on the drive track.
Figure 12:
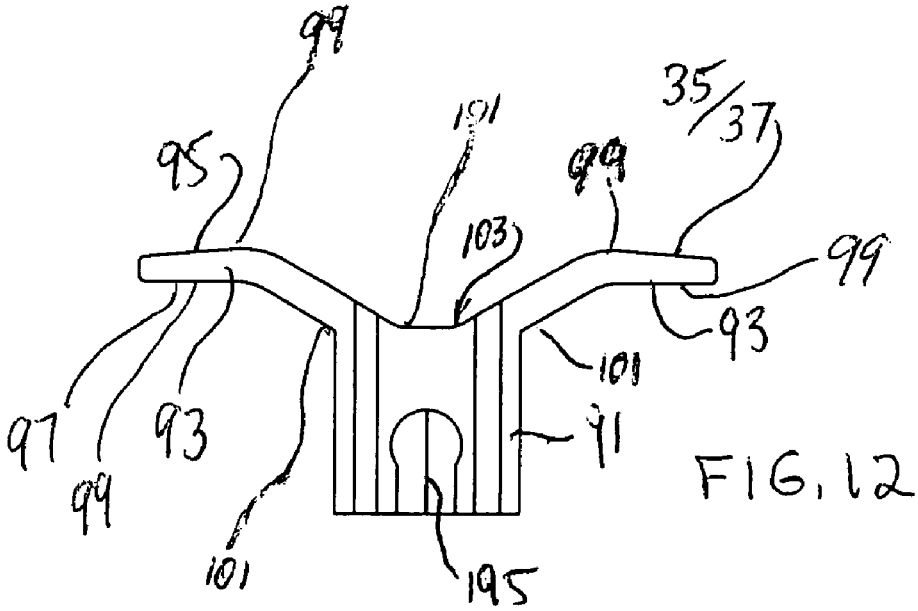
FIG. 12 is an end view of the track section of FIG. 11.
Figure 11:
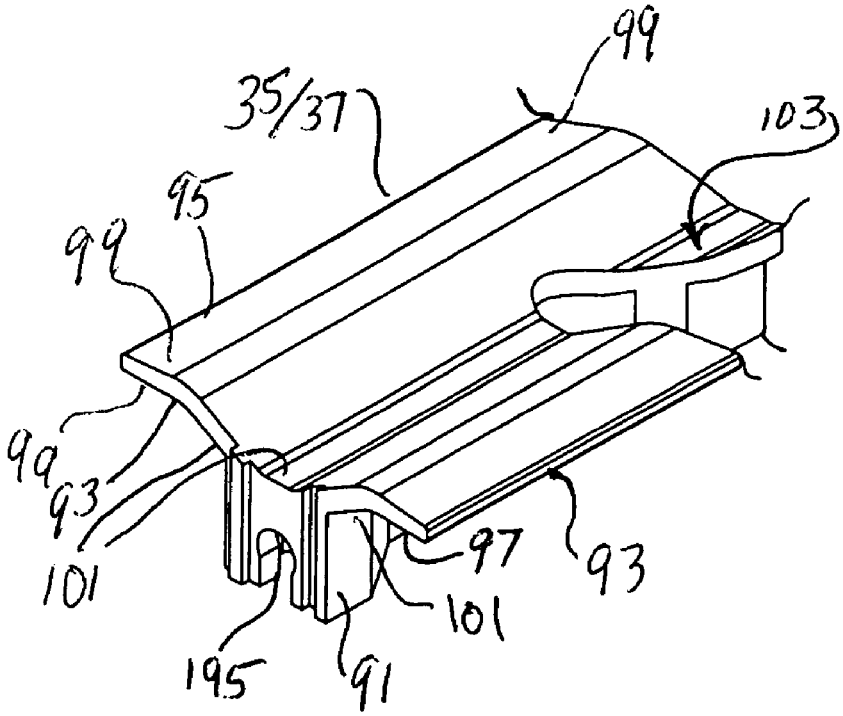
FIG. 11 is a partial, cut away, perspective view of a passive track section of the apparatus of this invention.
Figure 13:
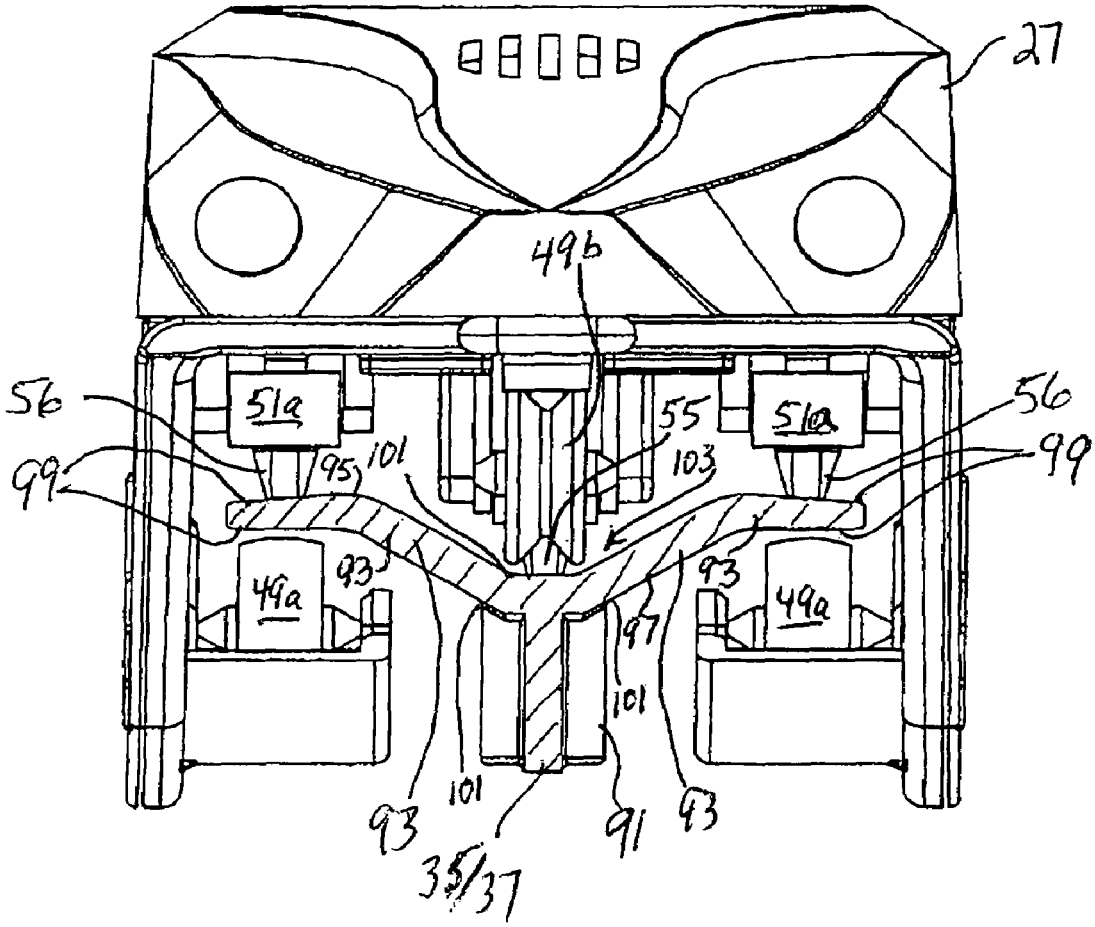
FIG. 13 is a front view of the vehicle on a section of the track of FIG. 11.

Track sections 35 of track assembly 31 all have in common a modified "Y" cross section characterized by a central support channel 91 and dual side supports 93, upper and lower surfaces 95 and 97, and first and second relative track elevations 99 and 101, respectively (see FIGS. 10 and 12). A central trough 103 is defined by the relative elevations 99/101 at upper surface 95 of track sections 35.

As shown in FIGS. 5 through 10, drive/lift mechanism 105 is utilized to operate drive track sections 35/39, and includes drive platform 107 including track guide 109 and housing 111. Platform 107 houses motor 113, having rotational to linear motion translation assembly 115 including gearbox 117 (the motor in the case of a roller coaster model is geared down to create a slow climb to the top of the ramp—approximately 40 seconds), rotary linkage 119, bar linkage 121, and track shuttle 123 connected therewith as shown. A DC adapter (not shown) may also be maintained in platform 107. Bar linkage 121 is pivotably mounted at one end at the outer circumference of rotary linkage 119, as shown, and at it other end receives one mounting pin 125 of shuttle 123. In this way, rotation of linkage 119 connected with motor 113 is translated to linear, reciprocating motion of shuttle 123 when the shuttle is mounted through slidable guide opening 127 at the bottom of track guide 109. Shuttle 123 is further guided by the slidable receipt of pins 125 in guide slot 128 established by structure at housing 111.

Guide opening 129 is of a size sufficient to accommodate the full extent of reciprocating motion of shuttle 123 enabled by linkages 119/121. Shuttle 123 includes mounting posts 131 and 133 at the upper surface thereof (and thus exposed through opening 129 when shuttle 123 is mounted).

Drive/lift mechanism 105 drives drive track sections 39. Drive track sections 139, when assembled, include first and second relatively reciprocating track members 141 and 143. Track members 141 (members 141*a* and 141*b*) are integral to side supports 93 (see FIG. 10) and have an engageable upper aspect (teeth 145, for example, though other engageable arrangements could be utilized). Drive track sections 39 work like a ratchet mechanism in association with appendages 51 of vehicle(s) 27/29. Teeth 145 at track members 141*a* and 141*b* engage tabs 56 of appendages 51*a* to prevent vehicle(s) 27/29 from sliding backward down drive track sections 39. Drive strip track members 143 are slidably held at trough 103 of track member 141 by slidable clips 147 through guide slots 149 (of a length sufficient to allow the full extent of reciprocation of track member 143). Each clip has a shoulder 151 at both clip arms at an upper extent thereof (see FIG. 8) that clips beneath slots 149. A properly positioned pair of clips 147 are in turn received in mounting posts 131 and 133 of shuttle 123.

Members 143 are flexible (to allow movement along curves) and have an engageable aspect (such as teeth 145) at the upper surface thereof. Drive strip track members 143 shuttle back and forth (reciprocate) relative to track members 141 for moving vehicle(s) 127/129 up an incline. Tab 55 of retractable appendage 51*b* repeatedly releasably engages track member 143. At each engagement of tab 55 with teeth 145 vehicle(s) 27/29 are carried forward with track member 143 as it moves forward under the influence of drive/lift mechanism 105. As vehicle(s) 27/29 are being moved forward, tabs 56 of appendages 51*a* repeatedly retract to allow unimpeded passage of tabs 56 up track members 141*a* and 141*b*. When track member 143 reciprocates backward, tab 55 is disengaged repeatedly allowing the unimpeded rearward movement of track member 143, and tabs 56 of appendages 51*a* engage teeth 145 at track members 141*a* and 141*b* thus preventing backsliding of the vehicle during the period between forward reciprocations of track member 143 (see FIGS. 9 and 10).

Figure 7C:
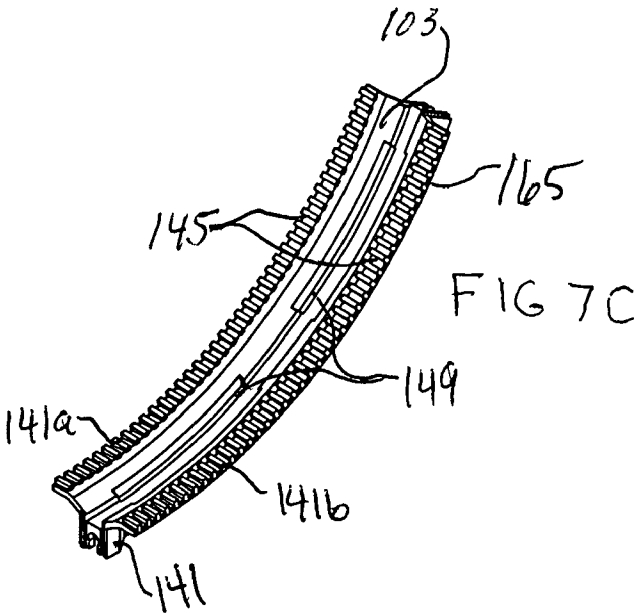
FIGS. 7A through 7C are perspective views of track components of the drive track shown in FIGS. 5 and 6.
Figure 7B:
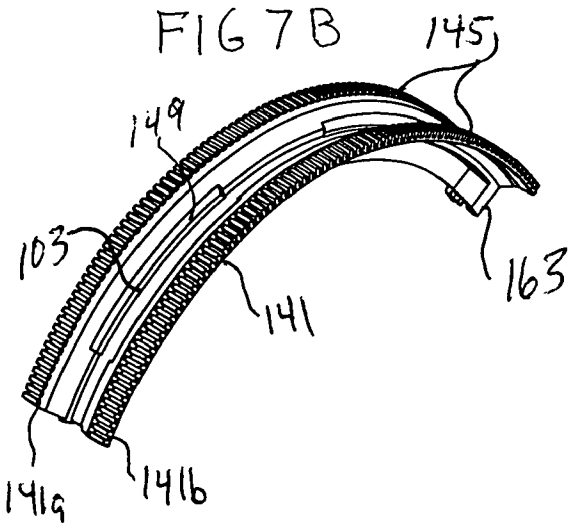
Figure 7A:
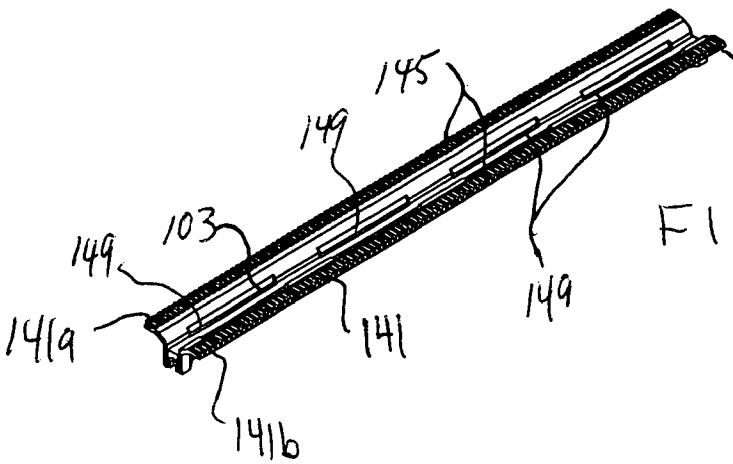

Drive track members 141 include differently contoured sections (FIG. 1), including straight track 161 (FIG. 7A), arced track 163 (FIG. 7B) and upwardly curved track 165 (FIG. 7C). Straight track 161 is used at drive platform 107 and between track 165 and 163. Upwardly curved track 165 (about a 60° track section in this embodiment, flexible up to about 80° for example) begins the upward climb. Track 163 is typically the last drive track section 39 and begins the downward curve after the entire lift (in this embodiment, approximately 120° arc is utilized).

Figures 8A, 8B, 8C:
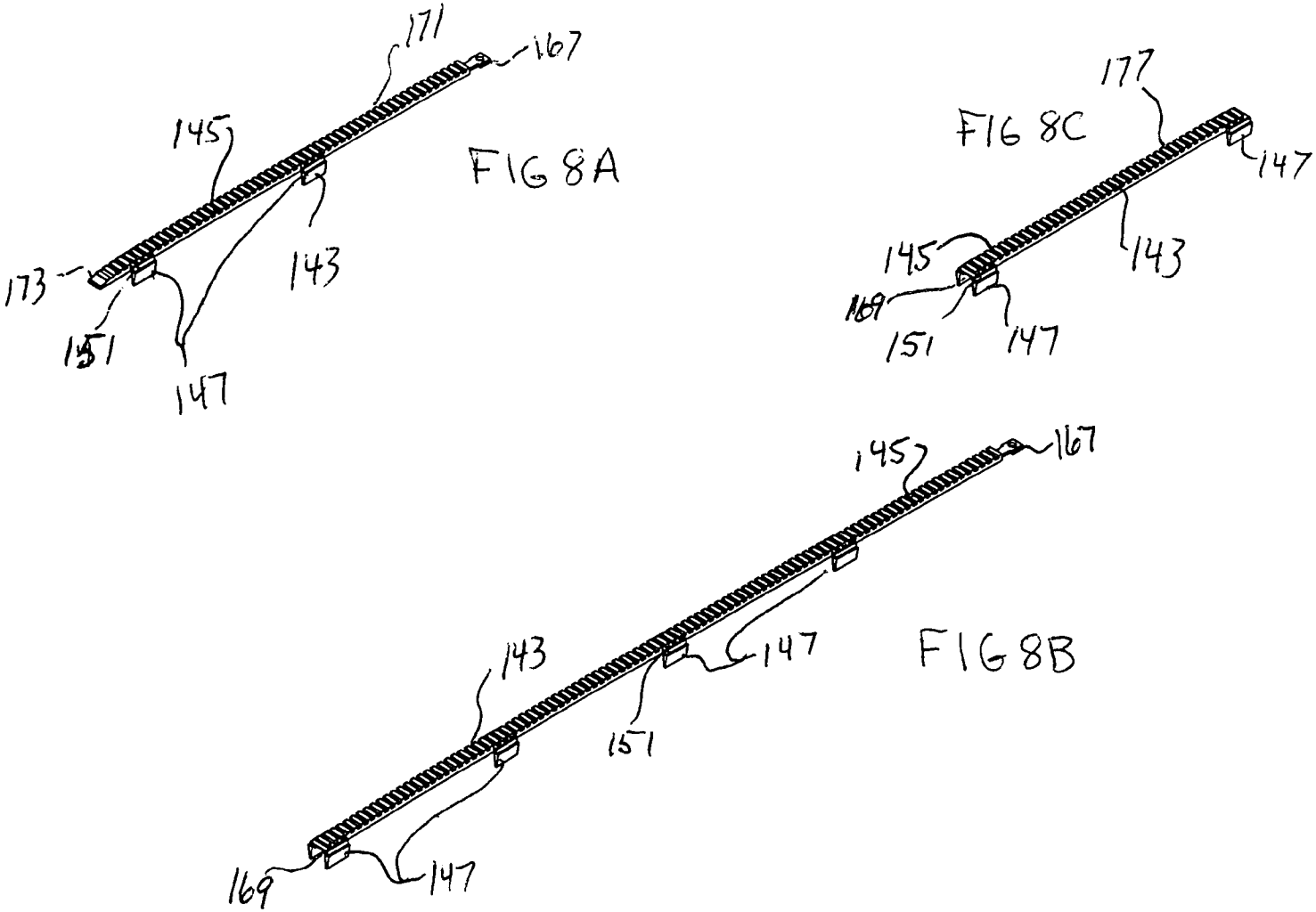
FIGS. 8A through 8C are perspective views of movable track components of the drive track shown in FIGS. 5 and 6.
Figure 9:
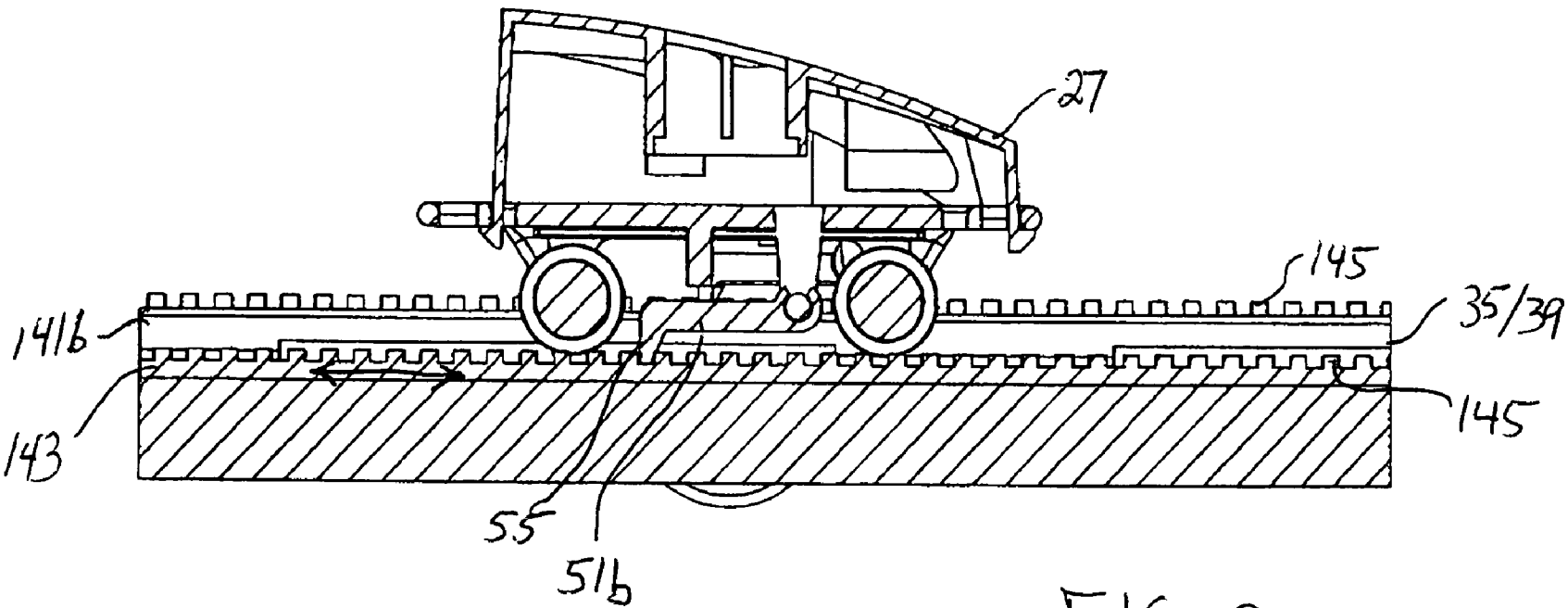
FIG. 9 is a sectional illustration of the vehicle on the drive track.

The drive track sections 39 in combination are designed so that vehicles 27/29 are always pushed up and over the top curve section until vehicles start their own free fall on passive track sections 37. In one embodiment having only a single drive vehicle 27 (i.e., provided with appendages 51), this is done with up to 5 vehicles 27/29 per vehicle train (by providing additional vehicles 29 having appendages 51, a greater number of vehicles 27/29 may be provided per vehicle train). Drive track sections are connected and supported the same as regular track (as discussed hereinafter). Drive strip track members 143 are attached to each other with built in connectors 167 with a hole at their center held in recessed square pockets 169 having a small post at its center for receipt in the center holes of connectors 167 (see FIG. 8). This type of connection allows for a solid connection under load in both directions of motion, and is seamless in appearance and very easy to assemble. Lead strip 171 includes a ramped leading edge 173 allowing smooth forward travel of vehicle(s) 27/29 thereover and connector 167 at its opposite end (FIG. 8A). Central strips 175 (FIG. 8B) include both connectors 167 and pockets 169 at opposite ends. Trailing strip 177 includes only pocket 169 at one end.

While backsliding could be prevented utilizing only a single appendage 51*a*, locking into teeth 145 on both sides of track member 141 keeps vehicle(s) 27/29 running straight when being lifted.

Figure 18:
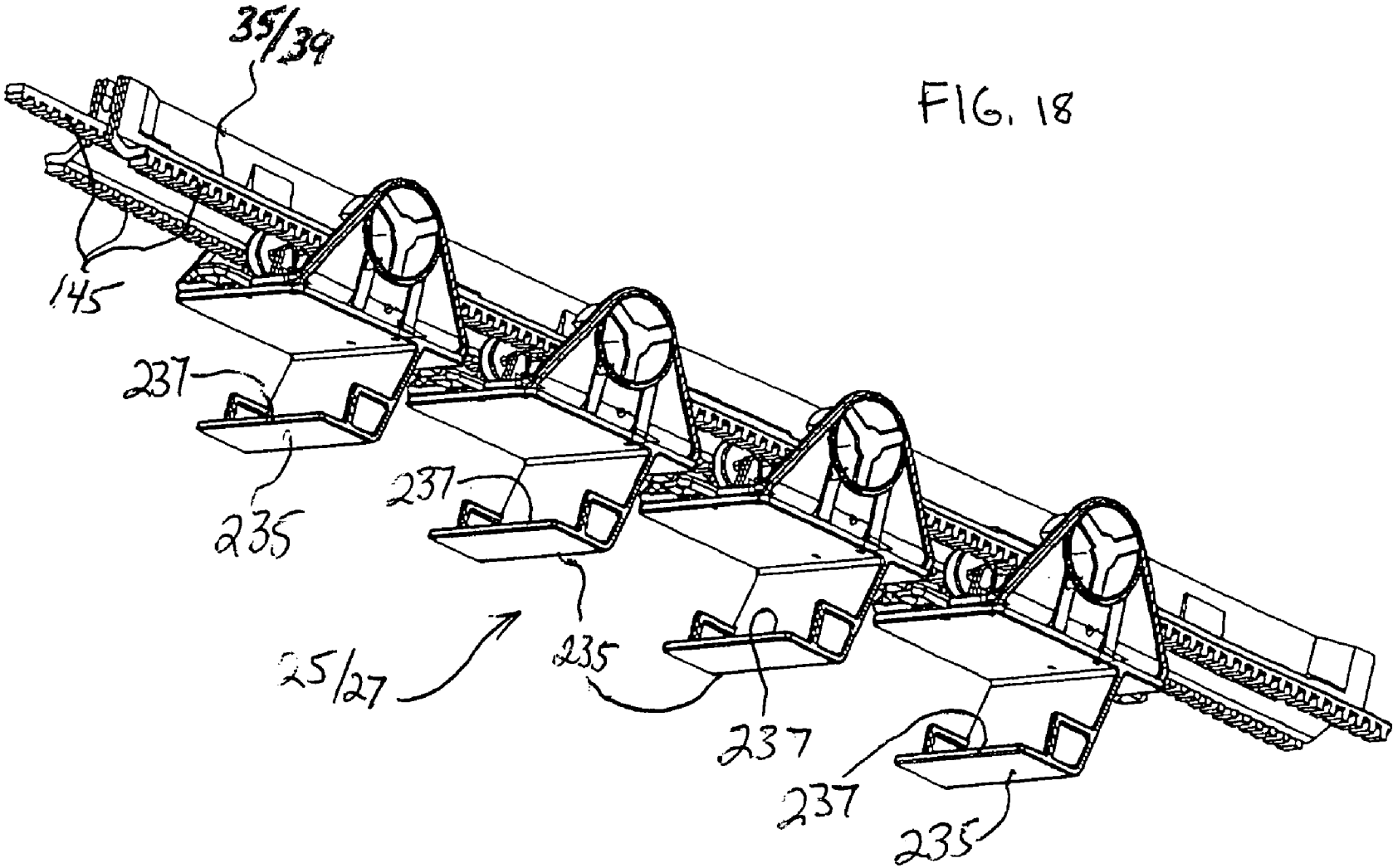
FIG. 18 is a perspective view illustrating a second embodiment of the vehicles of this invention suspended from the track.

Passive track sections 37 are illustrated in FIGS. 11 through 14. Each track section has a modified "Y" shape in this embodiment (like many full size coasters tracks or monorails). This type of constructions provides strength, rigidity and best tracking of vehicles through straight, twisted and/or curved sections. Moreover, the track can also be inverted and used for hanging or swinging variation of vehicles (as shown in FIG. 18). Track sections 37 are preferably made of Polypropylene for its low coefficient of friction on moving vehicles. Polypropylene also provides rigid yet flexible qualities allowing flexibility on track layouts and snap joint features. Each track section may be provided with a hole located somewhere along trough 103 for holding a small magnet used as a switch activator for sound electronics as discussed above.

Figure 14B:
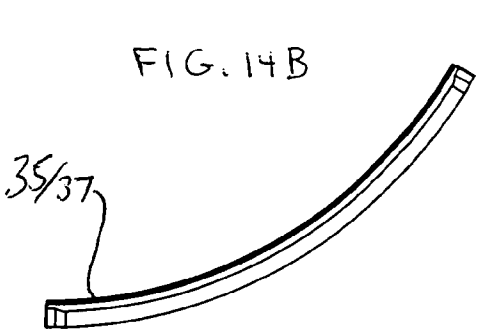
FIGS. 14A through 14E are views of the various configurations for sections of the passive track.
Figure 14D:
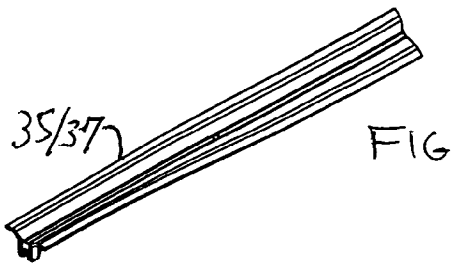
Figure 14E:
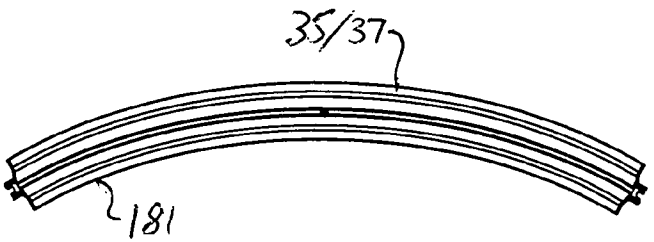
Figure 14A:
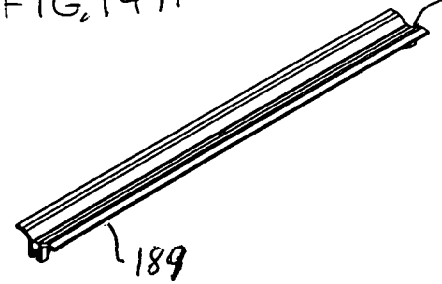
Figure 14C:
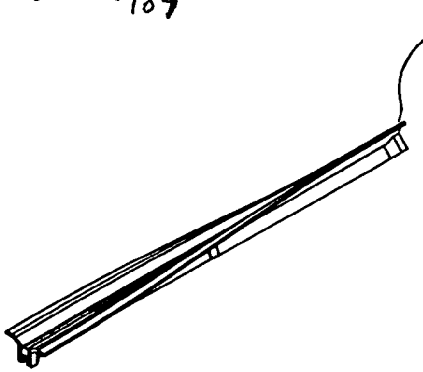

Curved sections 181 (FIG. 14E) are banked. Although the tracks are somewhat flexible, transition sections 185 and 187 (FIGS. 14C and 14D—providing different twist directions), are designed to fit between banked curves and longer straight sections 189 (FIG. 14A—which may come in various lengths). This is also required for vehicles to maintain momentum and run true on the track assembly, and prevents twisted track sections from putting undesirable loading into track layout and individual track connections. Sweep section 191 (FIG. 14B) is used at the bottom of downhill runs.

Wheels 49 are mounted both top and bottom of track sections 35 and account for the bulk of the vehicle 25/27 weight. Because the top wheels 49*b* ride in trough 103 (i.e., at track elevation 101 of top surface 95 and remaining lateral of track elevations 101) their centerlines are very near the centerlines of the bottom wheels 49*a*. This results in the center of gravity being very low on the track assembly 31 as desired.

Figure 15:
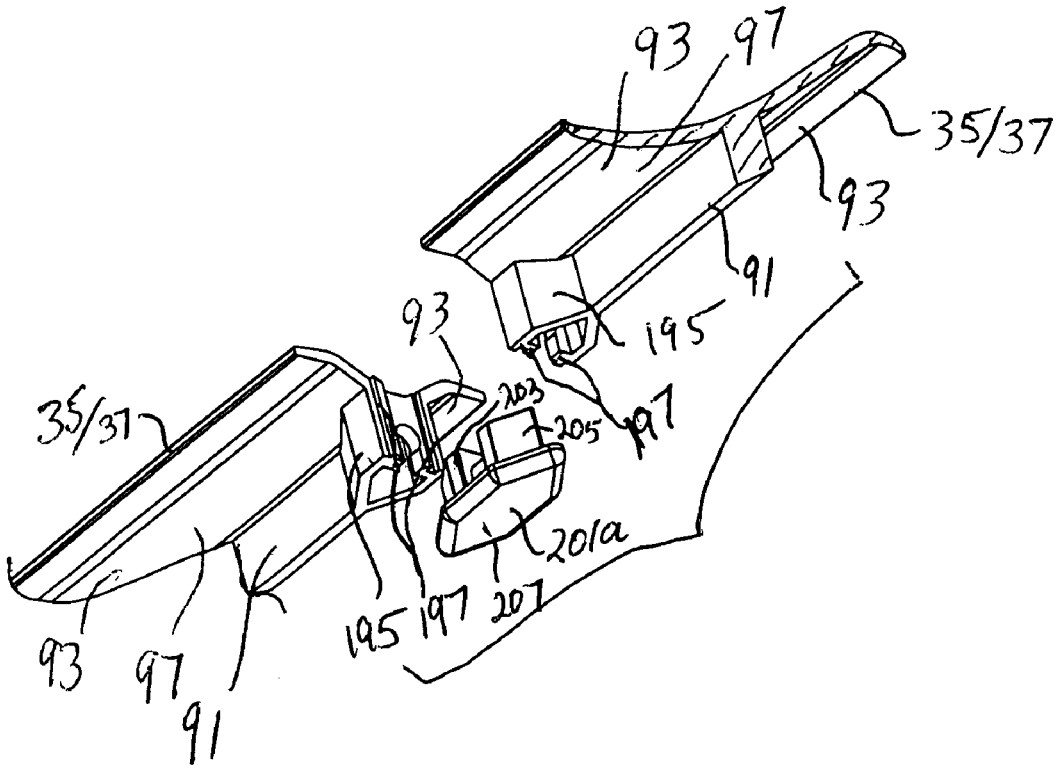
FIG. 15 is a partial exploded view of two track sections and one type of section joiner.
Figure 16A:
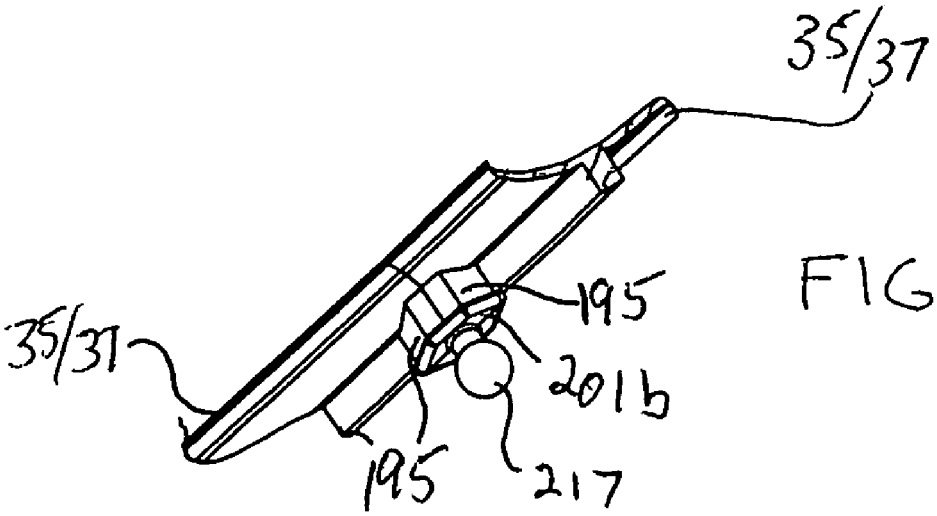
FIG. 16A and 16B are perspective views of two other types of section joiners holding track sections together.
Figure 16B:
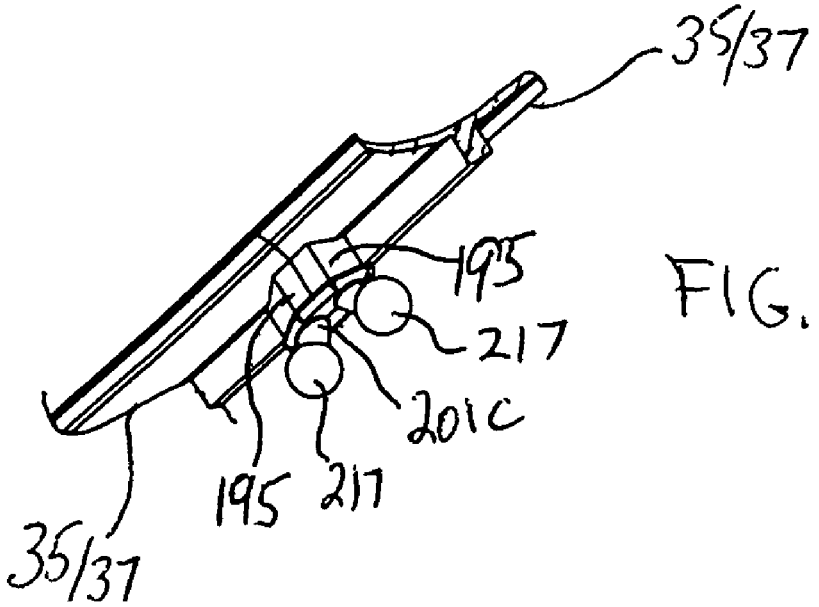

All track sections 35 of this invention are easy to assemble utilizing snap joint connections 195 at section ends (see FIGS. 15 and 16 illustrating connections of sections 37 though the same connecting systems are utilized with drive track sections 39). Each connection 195 includes interlocking ribs 197 (male and female at adjoining track section ends) to provide seamless joints. This will ensure a smooth ride with least resistance to the rolling vehicles. Connectors 201 are receivable in the adjoining connections 195 of track section 35 to be linked (three different types, 201*a*, 201*b* and 201*c*, shown in FIGS. 15 and 16A and 16B, respectively, 201*b* and 201*c* having a different secondary purpose beyond track interconnection). Connectors 201 include spaced connector blocks 203 and 205 extending from deck 207, each block receivable in a different one of the adjacent connections 195 to lock the track section linkage.

Figure 17:
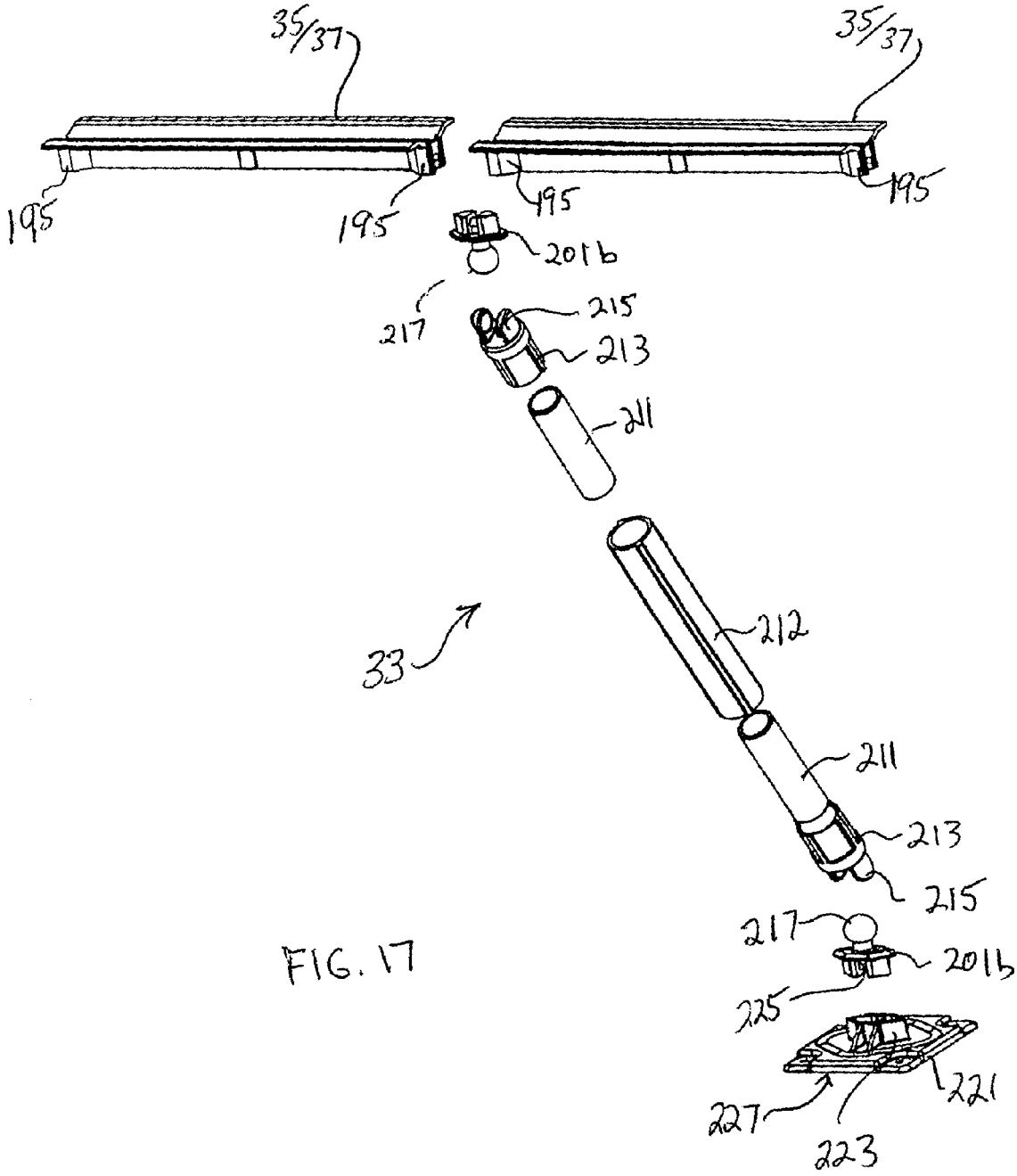
FIG. 17 is an exploded view of a truss assembly for track elevation, directing and support.

One example of the supporting assemblies 33, used to elevate and support track assembly, is illustrated in FIG. 17 used in association with track sections 37 (the same supporting assemblies can be utilized with track section 39). Support assembly 33 includes one of connectors 201*b* or 201*c* at both its top and bottom (providing for one leg—connector 201*b*—or two leg—connector 201*c*—support systems extending from either or both the top or bottom of assembly 33 as may be appreciated). Assemblies 33 are thus positionable at track section linkages selected to support the track assembly 31 for dynamic loading when placed at proper angles or for raising and lowering adjoined track sections to adjust inclines. Assemblies 33 can also be twisted to control pitch of adjoining track sections.

Each assembly 33 preferably includes two rigid end members 211 and one central ribbed (outer ribs for ease of handling) locking member 212 (preferably plastic extrusions) cut to various lengths. End members 211 are of a size to snugly receive end fitting 213 having engaging structures 215 thereat (ball receiving structures, for example, to snugly but pivotably and rotatably receive rubberized balls 217 integrally formed at connectors 201*b* or 201*c*). Members 211 and 212 are both oval in shape with hollow centers. The opening at the ends of member 212 are larger than the outside diameter of members 211 allowing members 211 to slide freely inside member 212. The oval shape allows for the tubes to telescope to exact length and then be locked into position by twisting member 212 relative to members 211. The twisting forces the major diameter of members 211 to interfere with the minor diameter of member 212. A small rib (not shown) is added to the outside of member 211 and inside of member 212 to act as stops while in maximum lock position.

The end fittings 213 have the same shape as the member 212 for a similar locking technique. End fittings 213 may each be provided with a small post (not shown) located in between the flanges of engaging structures 215 that also engages rubberized ball 217 to increase contact for holding any end fitting 213 at any position it has been set in. Twisting end fitting 213 can control the track pitch. By changing the angle of engagement the pitch of the track will change as desired. Members 211 are preferably 3-6" long, member 212 being cut to length as desired.

Balls 217 are over molded with a low durometer rubber that create a high friction surface used for holding set positions. Multiple ball connectors 201*c* are used for locations requiring multiple supporting assemblies 33 or for horizontal links between track sections needing additional stability. Ground base 221 includes connection 223 (having a structure like that of a paired set of connections 95 when engaged at engaging ribs 195 and 197. Connection 223 receives connector 201*b* or 201*c* with same fit as found at the upper track sections connections 95, and include tabs (not shown) at the interior thereof that snap over connector rib 225 to assure securement of base 221 with the assembly.

Base 221 preferably includes a Velcro "hook side" strip on its bottom surface 227 for assembly layouts on carpeted floors. Base surface 227 is preferably recessed for the Velcro "hook side" so that base sits flat on hard flooring. The recessed area may be designed to flex so that it can be pushed into carpet and grab the fiber loops. Other base mounting options (attaching adhesive backed Velcro "loops side" to tile flooring for bases to attach to, or holes at each corner for fasteners such as screws, nails or pins, and the like) could be utilized.

Support assembly 33 not designed for any specific track assembly 31 layout. It is designed for more creative use with the ability to place and position assemblies such that they can stabilize any configuration given general guidelines.

An alternative embodiment 235 of vehicles 25/27 are shown in FIG. 18. These vehicles are designed for suspended roller coaster car modes (i.e., where the track is generally above the vehicles), and included suspended seats 237. These structures (as well as all track sections) are similar in most regards to those previously described (appendages 51 would probably require biasing toward drive track sections teeth 145 engagement). Additional support structures apparent to those skilled in the art for use with assemblies 33 would be required to hang track assembly 31.

What is claimed is:

1. A track and vehicle amusement apparatus comprising:

a plurality of track sections each having a length, first and second oppositely facing surfaces, and first and second relative track elevations at least at said first surface, said first relative track elevation extending longitudinally said length of each said track section, each said track section including connecting structure at opposite ends thereof adjacent to said first relative track elevation, said plurality of track sections including at least a first drive track section having relatively reciprocating members;

connectors engageable at said connecting structure of said track sections, at least some of said connectors including a fitting at a surface thereof and configured for rotatable engagement therewith;

track support and elevation members selectively configurable in various lengths and each including an engaging structure rotatably engageable with a selected said fitting of said some of said connectors; and a first vehicle mountable on said track sections, said first vehicle including at least a first retractable appendage repeatedly releasably engageable at one of said relatively reciprocating members, said relatively reciprocating members of said drive track section adapted to move said vehicle by reciprocating relative motion.

2. The track and vehicle amusement apparatus of claim 1 wherein said first vehicle has at least first, second and third wheels, said first wheel adapted for positioning adjacent to said first surface at said first relative track elevation of said track sections and said second and third wheels for positioning adjacent to said second surface at said second relative track elevation of said track sections.

3. The apparatus claim 1 wherein said track support and elevation members include opposite end fittings engageable at a ground base.

4. The apparatus of claim 1 wherein at least some of said track support and elevation members include a telescopable tube for length adjustment of said members.

5. The apparatus of claim 1 further comprising a drive mechanism having a rotational drive and means for translating rotational motion to linear motion connected between said rotational drive and one of said relatively reciprocating members.

6. A track assemblage for a track and vehicle amusement apparatus including a vehicle mountable at the track assemblage, said track assemblage comprising:

a plurality of track sections each having a length, first and second oppositely facing surfaces, and first and second relative track elevations, said first relative track elevation extending longitudinally said length of each said track section, said track sections having a central support channel extending at said second surface longitudinally said length of each said track section, each said track section including snap joint connections established at opposite ends of said central support channel adjacent to said first relative track elevation;

connectors releasably engageable at said snap joint connections of adjacent said track sections, each of said connectors including first and second connector blocks, said first connector block receivable in a said snap joint connection of one of said adjacent said track sections and said second connector block receivable in a said snap joint connection of another of said adjacent said track sections, at least some of said connectors including a linkage at a surface thereof configured for rotatable releasable engagement; and a plurality of track support and elevation assemblies selectively configurable in various lengths and each including an end fitting rotatably releasably receiving a selected said linkage of said some of said connectors.

7. The track assemblage of claim 6 wherein at least some of said track support and elevation assemblies include telescopable tubes having plural releasably securable members configured to allow length adjustment of said tubes and therefore elevation adjustability of said some of said assemblies.

8. The track assemblage of claim 6 wherein said plurality of track support and elevation assemblies include opposite end fittings and a ground base having a connection thereat, said ground base connection configured for releasably receiving one of said at least some of said connectors therein so that said linkage thereof is rotatably and releasably receivable in said opposite end fitting.

9. The track assemblage of claim 8 wherein said ground base includes a securing structure at a bottom surface thereof for securing position location of said ground base on a floor.

10. The track assemblage of claim 6 further comprising a first drive track section having first and second relatively reciprocating members, said drive track section positioned intermediate selected ones of said track sections.

11. The track assemblage of claim 6 wherein said support channel is at said first relative track elevation.

12. The track assemblage of claim 6 wherein said track sections include dual side supports extending from said central support channel and defining a transition from said first relative track elevation to said second relative track elevation.

13. The track assemblage of claim 6 wherein said linkage of said at least some of said connectors include at least one ball and wherein said end fittings of said plurality of track support and elevation assemblies include ball receiving structures.

14. The track assemblage of claim 13 wherein said ball includes a high friction surface application.

15. A track and vehicle amusement apparatus comprising:

a plurality of track sections each having a length, first and second oppositely facing surfaces, and first and second relative track elevations, said first relative track elevation extending longitudinally said length of each said track section, each of said track sections including a central support channel and dual side supports, said central support channel extending from said second surface longitudinally said length of each said track section and adjacent to said first relative track elevation and said dual side supports extending from said central support channel and defining a transition from said first relative track elevation to said second relative track elevation, each said track section including connecting structure at opposite ends of said central support channel;

connectors engageable at said connecting structures of adjacent ones of said track sections, each of said connectors having first and second portions receivable in different ones of said connecting structures of said adjacent ones of said track sections, at least some of said connectors including a linkage at a surface thereof;

track support and elevation assemblies at least some of which are telescopable providing selectable track elevations and each including an engaging structure rotatably engageable with a selected said linkage of said some of said connectors;

at least a first drive track section having first and second relatively reciprocating members, said drive track section positioned intermediate said track sections;

a drive mechanism having a rotational drive and means for translating rotational motion to linear motion connected between said rotational drive and said first relatively reciprocating member of said drive track section; and a first vehicle mountable on said track sections and including a central wheel adapted for movement at said first relative track elevation of said track sections with said dual side supports at each side thereof, and further including a first pivotably retractable appendage repeatedly releasably engageable at said first relatively reciprocating member of said drive track section to move said vehicle.

16. The apparatus of claim 15 wherein said vehicle includes a second pivotably retractable appendage repeatedly releasably engageable at said second relatively reciprocating member of said drive track section to prevent backward movement of said vehicle at said drive track section.

17. The apparatus of claim 15 wherein said vehicle includes a body mountable on a truck having first and second lateral wings extending therefrom, and first and second lateral wheels freely rotatable in first and second releasable wheel mounts mountable at said first and second wings, respectively, of said truck, said wings and wheel mounts configured so that when said vehicle is mounted on said track sections said lateral wheels are positioned adjacent to said second surface of said track sections at different ones of said dual side supports, all said wheels rotatable in a common direction.

18. The apparatus of claim 15 wherein said first relatively reciprocating member of said drive track section includes clips spaced longitudinally along said first relatively reciprocating member and engageable with said means for translating rotational motion to linear motion of said drive mechanism.

19. The apparatus of claim 18 wherein said drive mechanism includes a drive platform having a track guide thereat, said track guide having linear guide openings therethrough, and a track shuttle having mounting posts extendible through said guide openings of said track guide and moveable therealong, said mounting posts receiving said clips of said first relatively reciprocating member of said drive track.

20. The apparatus of claim 19 wherein said means for translating rotational motion to linear motion of said drive mechanism includes a rotary linkage connected with said rotational drive and a bar linkage connected between said rotary linkage and said track shuttle.

* * * * *